US009997883B1

(12) United States Patent
Warden

(10) Patent No.: US 9,997,883 B1
(45) Date of Patent: Jun. 12, 2018

(54) APPARATUSES AND METHODS FOR REDUCING RISK OF BINDING BETWEEN TWO CONNECTORS DURING DECOUPLING OF THE TWO CONNECTORS

(71) Applicant: The Boeing Company, Chicago, IL (US)

(72) Inventor: Harry Kendall Warden, Huntsville, AL (US)

(73) Assignee: The Boeing Company, Chicago, IL (US)

( * ) Notice: Subject to any disclaimer, the term of this patent is extended or adjusted under 35 U.S.C. 154(b) by 0 days. days.

(21) Appl. No.: 15/481,638

(22) Filed: Apr. 7, 2017

(51) Int. Cl.
*H01R 39/00* (2006.01)
*H01R 35/04* (2006.01)
*H01R 13/633* (2006.01)

(52) U.S. Cl.
CPC ..... *H01R 35/04* (2013.01); *H01R 13/633* (2013.01)

(58) Field of Classification Search
CPC ..... H01R 35/04
USPC ..... 439/6, 8, 11, 13, 248, 247
See application file for complete search history.

(56) References Cited

U.S. PATENT DOCUMENTS 7,160,137 B1 * 1/2007 Yeh ..... H01R 13/6397 439/358
7,510,420 B2 * 3/2009 Mori ..... G06F 13/4022 379/446

* cited by examiner

*Primary Examiner* — Phuong Dinh
(74) *Attorney, Agent, or Firm* — McDonnell Boehnen Hulbert & Berghoff LLP

(57) ABSTRACT

In an example, a first connector is associated with a first component and a second connector is attached to a cable that is subjected to a pulling force to effect decoupling, and an example apparatus for reducing risk of binding between the two connectors during decoupling of the two connectors includes a bracket that is rigidly affixed to the first component and that supports the first connector so as to enable the first connector to automatically align with the pulling force. An example method for reducing risk of binding between the two connectors during decoupling of the two connectors includes securing a bracket to the first component, and the bracket includes a pivot bracket. The method also includes aligning the first connector with the pulling force via one or more of translational or rotational movement of the pivot bracket.

20 Claims, 8 Drawing Sheets

APPARATUSES AND METHODS FOR REDUCING RISK OF BINDING BETWEEN TWO CONNECTORS DURING DECOUPLING OF THE TWO CONNECTORS

GOVERNMENT LICENSE RIGHTS

This invention was made with Government support under Contract No. HQ0147-12-C-0004 awarded by the Department of Defense (DOD). The Government has certain rights in this invention.

FIELD

The present disclosure relates generally to an apparatus for reducing risk of binding between two connectors during decoupling of the two connectors, and more particularly to, an apparatus having bracket that is rigidly affixed to a component and that supports a connector so as to enable the connector to automatically align with a pulling force during decoupling.

BACKGROUND

Many launch vehicles (e.g., missile, rocket, or land vehicle), are coupled to a payload, which can range from a weapon to a commercial satellite. It is typical that a particular launch vehicle may be used with a range of payload types. However, under a conventional approach, a unique structural platform is designed for every unique payload to secure it to the launch vehicle or booster rocket. Thus, for every payload that may be employed with a given missile system—those currently existing and yet to be developed—a like number of payload platforms are generally developed.

The requirement of a custom structural adapter design for every payload configuration can negatively impact hardware development. New components require additional schedule to design, manufacture and test. In addition, developing new hardware also carries an increased risk of a failure, either in development or when it is first used. Of course, all of these factors bring additional costs.

Furthermore, there may be mission scenarios that will require the implementation of two or more different payloads, of varying weights and dimensions, on the same mission. For these mission scenarios it can become expensive, if not impossible, to develop unique adapters to accommodate every possible payload permutation ahead of time.

The structural adapter, in addition to securing the payload to the launch vehicle, is often required to be able to autonomously disconnect the payload from the launch vehicle as well. Such disconnection needs to occur without failures caused by manufacturing, assembly, vibration, or thermal variations of the adapter.

In view of the foregoing, there is a need for apparatuses and methods for structural coupling a wide range payloads to a common launch vehicle or booster rocket, and for enabling decoupling to occur without failure. Particularly, there is a need for such systems and methods to facilitate the development of structural adapters and interfaces without requiring excessive additional cost or schedule.

SUMMARY

In one example, an apparatus for reducing risk of binding between two connectors during decoupling of the two connectors is described. A first connector is associated with a first component and a second connector is attached to a cable that is subjected to a pulling force to effect decoupling. The apparatus comprises a bracket that is rigidly affixed to the first component and that supports the first connector so as to enable the first connector to automatically align with the pulling force.

Within examples, the bracket imparts multiple degrees of freedom of movement to the first connector, and the multiple degrees of freedom of movement comprise pitch, roll, yaw as well as shifting in an x-y plane.

Within examples, the bracket further comprises a mounting bracket, a spherical bearing disposed within the mounting bracket, a pivot bracket disposed adjacent the mounting bracket, and a shoulder bolt extending through the spherical bearing, the mounting bracket, and the pivot bracket.

Within examples, the shoulder bolt is oversized enabling the pivot bracket to move along a longitudinal axis of the shoulder bolt.

Within examples, the mounting bracket includes a mount in which the spherical bearing is disposed, and the pivot bracket is positioned over the mount with the shoulder bolt extending through the spherical bearing, the mount, and the pivot bracket.

Within examples, the pivot bracket is positioned over the mount such that a space resides between the shoulder bolt and the pivot bracket.

Within examples, the mounting bracket includes a base, and a first arm and a second arm coupled to sides of the base, and a first end of the pivot bracket is coupled to a mount of the base and a second end of the pivot bracket is coupled to the first connector, and the first arm and the second arm of the mounting bracket extend beyond the second end of the pivot bracket.

Within examples, the pivot bracket is attached to the mounting bracket and a space is provided between the second end of the pivot bracket and each of the first arm and the second arm enabling the pivot bracket to rotate via the spherical bearing with respect to the mounting bracket.

Within examples, the pivot bracket is connected to the mounting bracket via the shoulder bolt and the spherical bearing enabling five degrees of freedom of movement of the pivot bracket with respect to the mounting bracket.

Within examples, the pivot bracket includes an opening through which the shoulder bolt extends enabling longitudinal translation freedom of movement, the pivot bracket is coupled to the mounting bracket with clearance enabling lateral translation freedom of movement, and the pivot bracket is coupled to the spherical bearing with clearance enabling yaw, pitch, and roll freedom of movement.

Various examples of the apparatus(es) described herein may include any of the components, features, and functionalities of any of the other examples of the apparatus(es) described herein in any combination.

In another example, a method for reducing risk of binding between two connectors during decoupling of the two connectors is described. A first connector is associated with a first component and a second connector is attached to a cable that is subjected to a pulling force to effect decoupling. The method comprises securing a bracket to the first component, and the bracket includes a pivot bracket. The method also comprises aligning the first connector with the pulling force via one or more of translational or rotational movement of the pivot bracket.

Within examples, the bracket further comprises a mounting bracket and the pivot bracket is disposed adjacent the mounting bracket, and the method further comprises inserting a spherical bearing within the mounting bracket, and extending a shoulder bolt through the spherical bearing, the mounting bracket, and the pivot bracket.

Within examples, the method further comprises the pivot bracket moving along a longitudinal axis of the shoulder bolt during decoupling.

Within examples, the method further comprises the pivot bracket rotating via the spherical bearing during decoupling.

Within examples, the pivot bracket is coupled to the mounting bracket with clearance, and the method further comprises the pivot bracket moving along a lateral axis of the mounting bracket during decoupling Within examples, the pivot bracket is coupled to the spherical bearing with clearance, and the method further comprises the pivot bracket moving along a yaw, a pitch, and a roll freedom of movement with respect to the spherical bearing.

In still another example, a method of decoupling two connectors is described. A first connector is associated with a first component rigidly affixed to a bracket that supports the first connector and a second connector is attached to a cable. The method comprise subjecting the cable to a pulling force, aligning the first connector with the pulling force via one or more of translational or rotational movement of a pivot bracket of the bracket, and decoupling the first connector and the second connector.

Within examples, subjecting the cable to the pulling force comprises causing an explosive force to decouple the first connector and the second connector.

Within examples, aligning the first connector with the pulling force comprises positioning the first connector using multiple degrees of freedom of movement of the pivot bracket including pitch, roll, yaw as well as shifting in an x-y plane.

Various examples of the method(s) described herein may include any of the components, features, and functionalities of any of the other examples of the method(s) described herein in any combination.

The features, functions, and advantages that have been discussed can be achieved independently in various examples or may be combined in yet other examples further details of which can be seen with reference to the following description and drawings.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying drawings, wherein:

DETAILED DESCRIPTION

Disclosed examples will now be described more fully hereinafter with reference to the accompanying drawings, in which some, but not all of the disclosed examples are shown. Indeed, several different examples may be described and should not be construed as limited to the examples set forth herein. Rather, these examples are described so that this disclosure will be thorough and complete and will fully convey the scope of the disclosure to those skilled in the art.

Within examples herein, a bracket is described to provide self-aligning features between two mated connectors, and is advantageously suited to circular connectors that are intended to be autonomously de-mated or decoupled. The bracket can also be used for rectangular connectors, or other configured and oriented connectors, where rotational and translational degrees of freedom are needed for decoupling. The bracket helps to lessen or eliminate any potential for the two mated connectors to bind, which may be caused by manufacturing, assembly, vibration, or thermal variations of an apparatus. In one example, an apparatus is described for reducing risk of binding between two connectors during decoupling of the two connectors. A first connector is associated with a first component and a second connector is attached to a cable that is subjected to a pulling force to effect decoupling. The apparatus includes a bracket that is rigidly affixed to the first component and that supports the first connector so as to enable the first connector to automatically align with the pulling force. The bracket may include a spherical bearing, a shoulder bolt, a mounting bracket, and a pivot bracket coupled to the first connector. The shoulder bolt is oversized so that the pivot bracket can move forward and backward in addition to right/left and roll/pitch movements enabled by the spherical bearing. The bracket configuration enables a smooth disconnect of the two mated connectors regardless of any connectors orientation.

Figure 1:
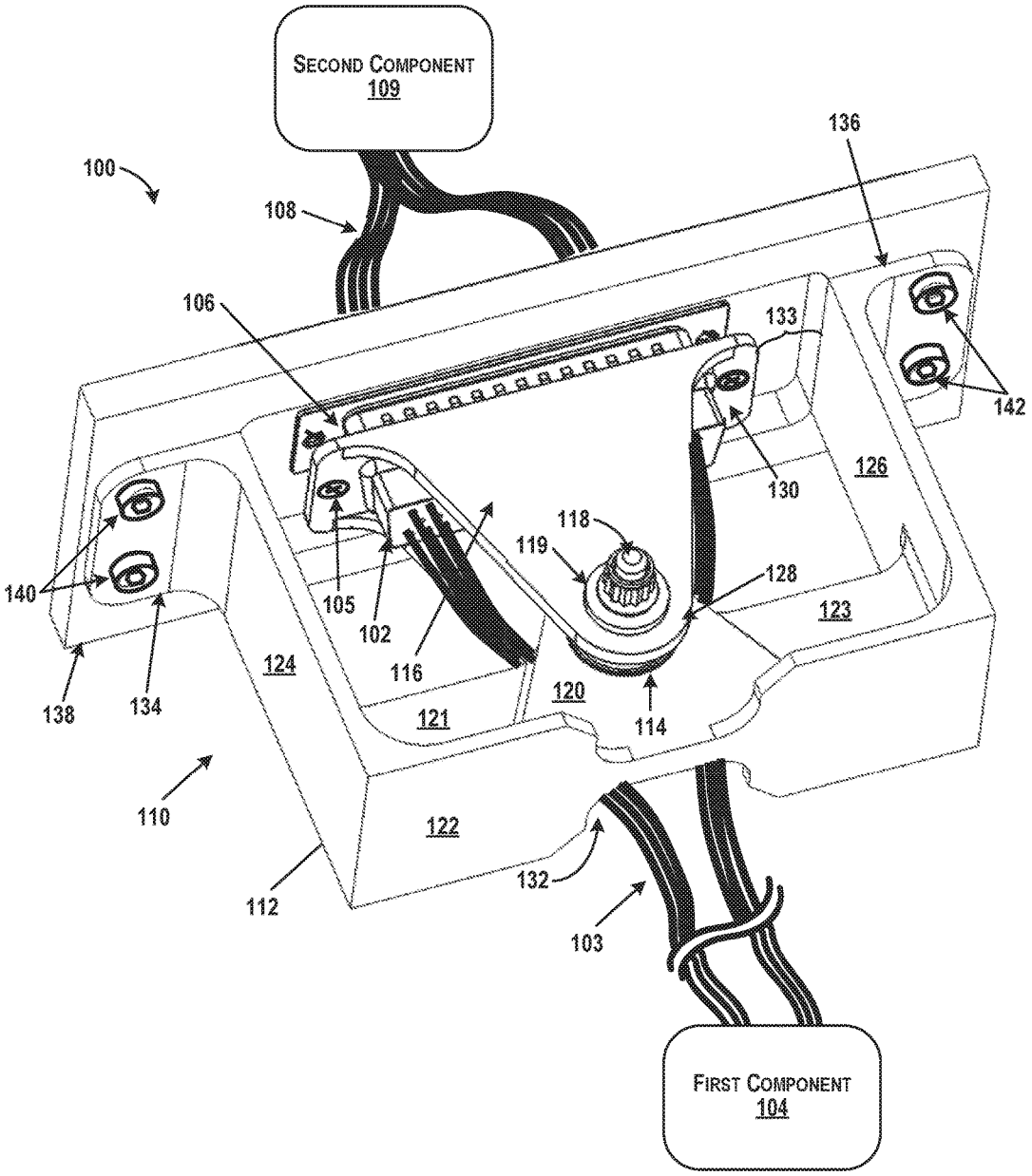
FIG. 1 illustrates a perspective view of an apparatus, according to an example implementation.

Referring now to FIG. 1, a perspective view of an apparatus 100 is illustrated, according to an example implementation. The apparatus 100 is configured to reduce risk of binding between two connectors during decoupling of the two connectors. A first connector 102 is associated with a first component 104 and a second connector 106 is attached to a cable(s) 108 that is subjected to a pulling force to effect decoupling. The apparatus 100 includes a bracket 110 that is rigidly affixed to the first component 104 and that supports the first connector 102 so as to enable the first connector 102 to automatically align with the pulling force.

The first connector 102 is connected to the first component 104 through cable(s) 103. The first connector 102 may be an electrical connector, and thus may include pins or slots to receive pins. The first connector 102 may also be a fluid connector to transfer fluid from the first component 104 to the second connector 106. In such an example, the cable(s) 103 and 108 may be replaced by fluid pathways, such as tubing. In addition, although the cable(s) 103 and 108 are shown as multiple cables, a single cable or wire, or a single cable harness or wire harness may be used. The first connector 102 may be any shapes (circular, rectangle, etc.) and may be configured in a male or female format.

The first component 104 may be any type of component such as an electrical component or electrical controller, or a fluidic component such as a fluid storage container, for example.

The second connector 106 is configured to secure to the first connector 102, and can be the male/female connector that matches to the female/male connector configuration of the first connector 102. The second connector 106 is attached to the cable(s) 108 that connect to a second component 109. The second component 109 can be similar to the first component 104 or complimentary to the first component 104 depending on an application of use of the apparatus 100.

The bracket 110 is rigidly affixed to the first component 104. As shown in FIG. 1, this includes a connection through the cable(s) 103. The bracket 110 can also be attached directly to the first component 104 through screws, bolts, or snap-fit, or molded to the first component 104 as well.

The bracket 110 includes a mounting bracket 112, a spherical bearing 114 disposed within the mounting bracket 112, a pivot bracket 116 disposed adjacent the mounting bracket 112, and a shoulder bolt 118 extending through the spherical bearing 114, the mounting bracket 112, and the pivot bracket 116. The shoulder bolt 118 connects the pivot bracket 116 to the mounting bracket 112, and the shoulder bolt 118 is secured in place using washers and nut 119.

The mounting bracket 112 includes a mount 120 in which the spherical bearing 114 is disposed, and the pivot bracket 116 is positioned over the mount 120 with the shoulder bolt 118 extending through the spherical bearing 114, the mount 120, and the pivot bracket 116.

Figure 4:
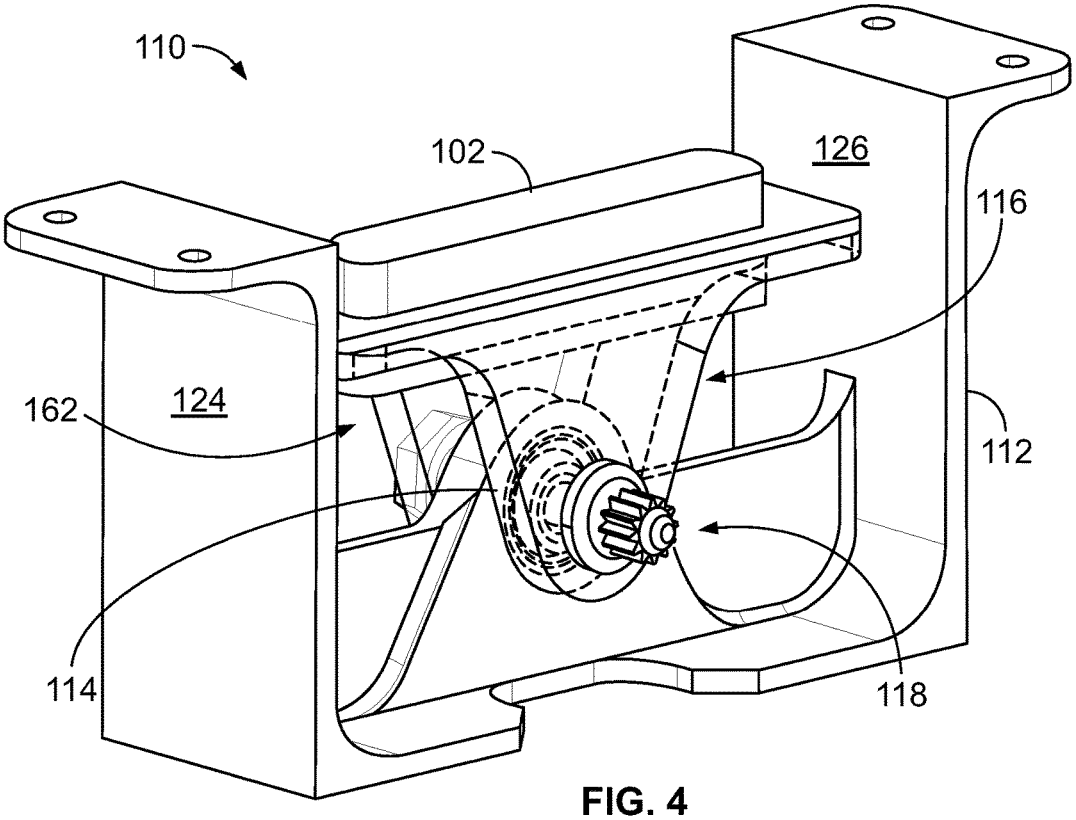
FIG. 4 illustrates a side view of the bracket with the first connector installed, according to an example implementation.

The mounting bracket 112 includes a base 122, and a first arm 124 and a second arm 126 coupled to sides of the base 122. In this example configuration, the mounting bracket 112 is a "U" shape. A first end 128 of the pivot bracket 116 is coupled to the mount 120 of the base 122 and a second end 130 of the pivot bracket 116 is coupled to the first connector 102. The first connector 102 is connected to the pivot bracket 116 using screws 105. As shown in FIG. 4 described below, the first arm 124 and the second arm 126 of the mounting bracket 112 extend beyond the second end 130 of the pivot bracket 116.

The mounting bracket 112 also includes supports 121 and 123 that connect sides of the mount 120 with the first arm 124 and the second arm 126, respectively. The base 122, the first arm 124, the second arm 126, the supports 121 and 123, and the mount 120 of the mounting bracket 112 can all be formed as an integral component, or as a single part, so that all of these features are manufactured to be integral into the mounting bracket 112, for example. In some examples, the mounting bracket 112 comprises aluminum, steel, or other metal.

The base 122 of the mounting bracket 112 includes a slot 132 to enable the cable(s) 103 to extend down to the first component 104. The cable(s) 103 can be routed around the shoulder bolt 118 through a center of the pivot bracket 116 and through the slot 132 to the first component 104.

The pivot bracket 116 is attached to the mounting bracket 112 and a space 133 is provided between the second end 130 of the pivot bracket 116 and each of the first arm 124 and the second arm 126 enabling the pivot bracket 116 to rotate via the spherical bearing 114 with respect to the mounting bracket 112. This enables a roll, pitch, and yaw freedom of movement of the pivot bracket 116 with respect to the mounting bracket 112 because the pivot bracket 116 may move into the space 133 as enabled by the spherical bearing 114. The spherical bearing 114 may be many sizes, and scaled up or down, enabling more or less freedom of movement along the roll, pitch, and yaw axis. The spherical bearing 114 may also comprised of TEFLON® and can rotate with application of low torque.

In addition, within examples, the shoulder bolt 118 is oversized enabling the pivot bracket 116 to move along a longitudinal axis of the shoulder bolt 118. The shoulder bolt 118 is also lubricated with a lubricant, such as grease or a dry film lubricant, allowing movement of the pivot bracket 116 along the shoulder bolt 118 more easily, for example. Thus, because the pivot bracket 116 is connected to the mounting bracket 112 via the shoulder bolt 118 and the spherical bearing 114, this enables five degrees of freedom of movement of the pivot bracket 116 with respect to the mounting bracket 112.

The cable(s) 103 that extends from the first connector 102 to the first component 104 can also have some extra length (e.g., slop) to allow movement of the pivot bracket 116 in various degrees of freedom.

The first arm 124 and the second arm 126 of the mounting bracket 112 include flanges 134 and 136. The flanges 134 and 136 enable connection of a plate 138 using screws 140 and 142 to the mounting bracket 112. The plate 138 is secured over the first connector 102 and functions to partially enclose the mounting bracket 112 and/or the first connector.

Figure 2:
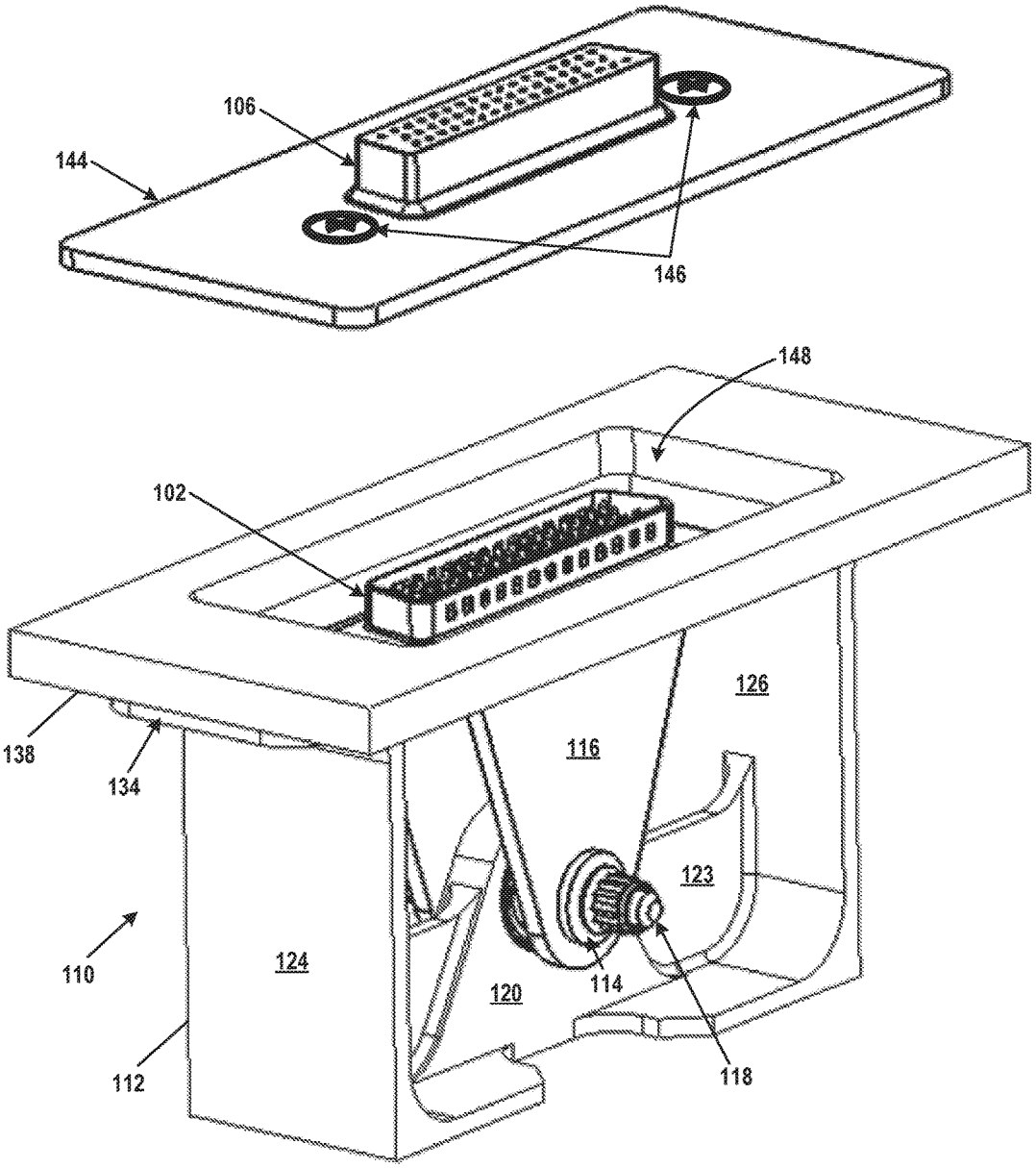
FIG. 2 illustrates a side view of the apparatus with the second connector disconnected, according to an example implementation.

FIG. 2 illustrates a side view of the apparatus 100 with the second connector 106 disconnected, according to an example implementation. The second connector 106 is attached to a plate 144 using screws 146. The second connector 106 can snap into the first connector 102, and the plate 144 abuts the plate 138 when the first connector 102 and the second connector 106 are coupled. The plate 138 and the plate 144 may be of substantially the same size. The plate 138 secured to the mounting bracket 112 includes an opening 148. Because the plate 144 is not connected to the plate 138, the first connector 102 and the second connector 106, when mated, have freedom of movement as enabled by the pivot bracket 116. The freedom of movement is restricted due to a size of the opening 148, for example. A size and shape of the opening 148 can be selected due to a size and shape of the first connector 102, for example.

Figure 3:
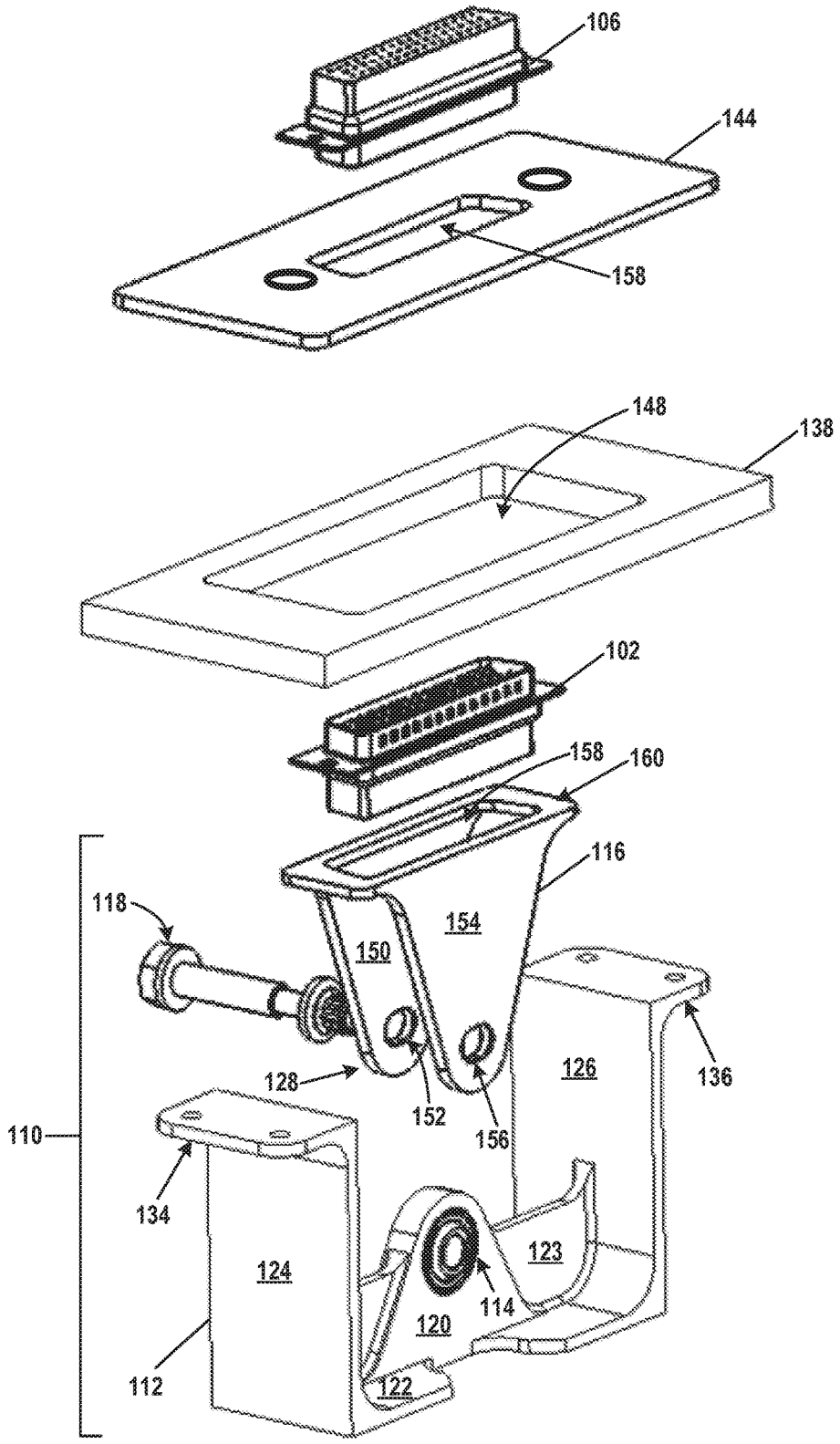
FIG. 3 is a schematic, side elevation, exploded view of the apparatus, according to an example implementation.

FIG. 3 is a schematic, side elevation, exploded view of the apparatus 100, according to an example implementation. In FIG. 3, the pivot bracket 116 is shown and includes a first leg 150 with an opening 152, and a second leg 154 with an opening 156. The opening 152 and the opening 156 are in a lateral direction through the pivot bracket 116. The first leg 150 and the second leg 154 slide over the mount 120 so that the opening 152 and the opening 156 line up with the spherical bearing 114. The shoulder bolt 118 may then be inserted through the opening 152, the spherical bearing 114, and the opening 156 to secure the pivot bracket 116 to the mount 120 of the mounting bracket 112.

The pivot bracket 116 also includes an opening 158 on a top surface 160 of the pivot bracket 116 into which the first connector 102 is positioned. Then, the first connector 102 is connected to the pivot bracket 116 using screws 105 (shown in FIG. 1). The first connector 102 is thus fixed to the pivot bracket 116, and the pivot bracket 116 moves relative to movement of the first connector 102.

The first leg 150 and the second leg 154 of the pivot bracket 116 are triangular in shape to enable rotation of the pivot bracket 116 via the spherical bearing 114. The triangular shape provides clearance at the first end 128 of the pivot bracket 116 for the pivot bracket 116 to rotate and not contact the base 122 of the mounting bracket 112.

FIG. 3 also shows the plate 144 includes an opening 158 into which the second connector 106 is positioned. The second connector 106 is attached to a plate 144 using screws 146, as shown in FIG. 2.

FIG. 4 illustrates a side view of the bracket 110 with the first connector 102 installed, according to an example implementation. The first connector 102 extends through the opening 158 of the pivot bracket 116, and a portion 162 of the first connector 102 may reside under the top surface 160 of the pivot bracket 116, for example.

Figure 5:
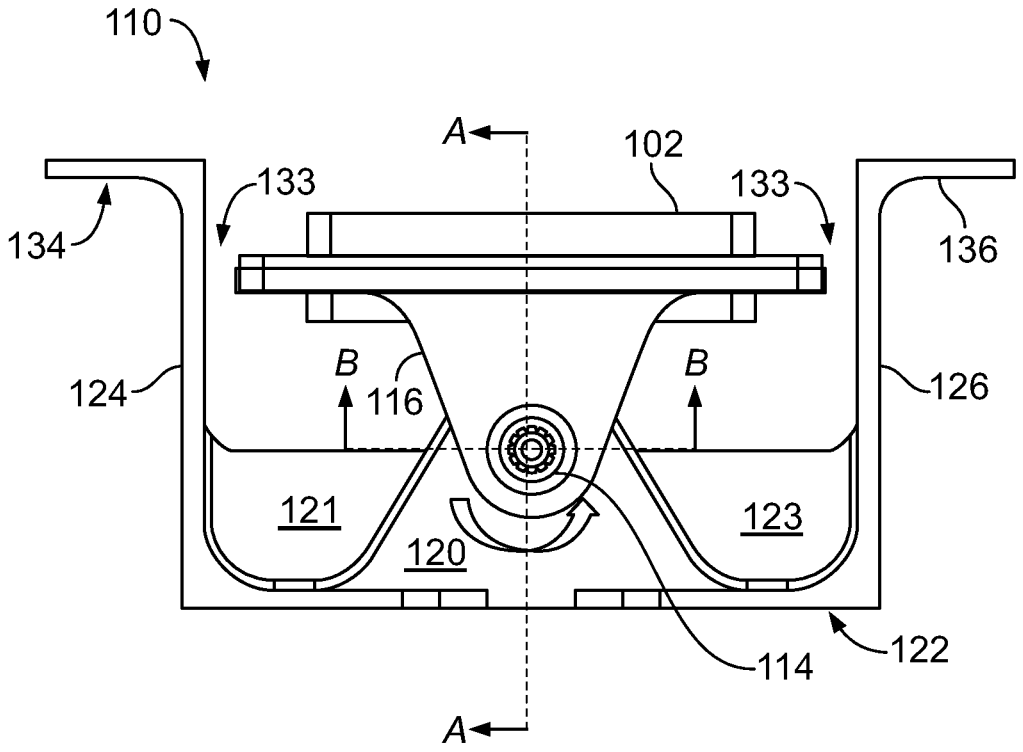
FIG. 5 illustrates a front view of the bracket, according to an example implementation.

FIG. 5 illustrates a front view of the bracket 110, according to an example implementation. This view illustrates the pivot bracket 116 attached to the mounting bracket 112 and the space 133 provided between the second end 130 of the pivot bracket 116 and each of the first arm 124 and the second arm 126 enabling the pivot bracket 116 to rotate via the spherical bearing 114 with respect to the mounting bracket 112.

Figure 6:
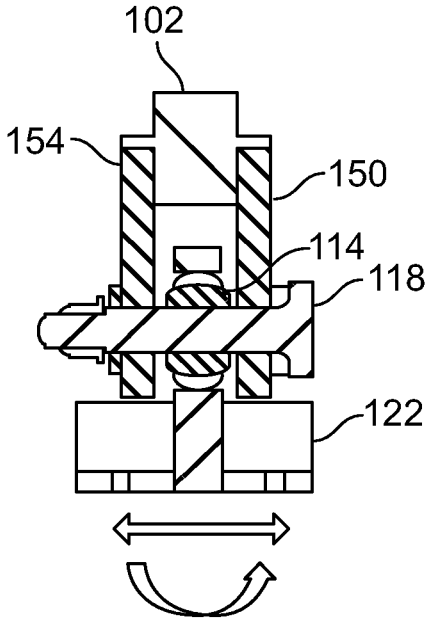
FIG. 6 illustrates a side view of the bracket along lines A-A of FIG. 5, according to an example implementation.

FIG. 6 illustrates a side view of the bracket 110 along lines A-A of FIG. 5, according to an example implementation. Within an example, the shoulder bolt 118 is oversized enabling the pivot bracket 116 to move along a longitudinal axis of the shoulder bolt 118.

Figure 7:
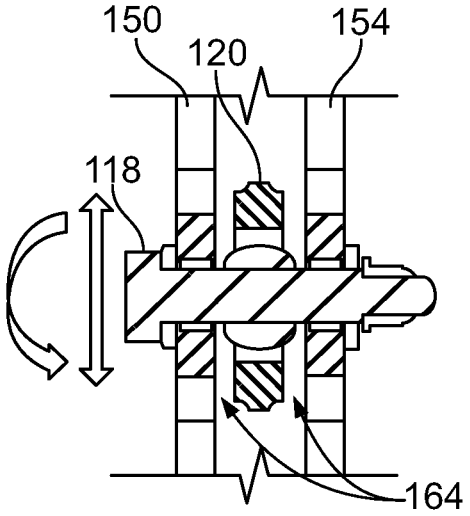
FIG. 7 illustrates a top view of a portion of the bracket along lines B-B of FIG. 5 focusing on the pivot bracket and mounting bracket connection, according to an example implementation.

FIG. 7 illustrates a top view of a portion of the bracket 110 along lines B-B of FIG. 5 focusing on the pivot bracket 116 and mounting bracket 112 connection, according to an example implementation. As shown, the first leg 150 and the second leg 154 are positioned on either side of the mount 120 of the mounting bracket 112, and the shoulder bolt 118 extends through the first leg, the mount 120 and the second leg 154. The pivot bracket 116 is sized such that a width of the top surface 160 enables a distance between the first leg 150 and the second leg 154 to be such that open space 164 resides between the first leg 150 and the mount 120 and between the second leg 154 and the mount 120. Thus, pivot bracket 116 is positioned over the mount 120 such that a space resides between the shoulder bolt 118 and the pivot bracket 116. The open space incorporated between the mount 120 and the pivot bracket 116 enables additional clearance to provide freedom of movement of the pivot bracket 116 along a longitudinal axis of the shoulder bolt 118, or in an x-y plane, for example.

Within examples, the pivot bracket 116 includes the opening 152 and the opening 156 through which the shoulder bolt 118 extends enabling longitudinal translation freedom of movement. The pivot bracket 116 is also coupled to the mounting bracket 112 with clearance and the open space 164 enables lateral translation freedom of movement. Furthermore, the pivot bracket 116 is coupled to the spherical bearing 114 with clearance enabling yaw, pitch, and roll freedom of movement.

Figure 8:
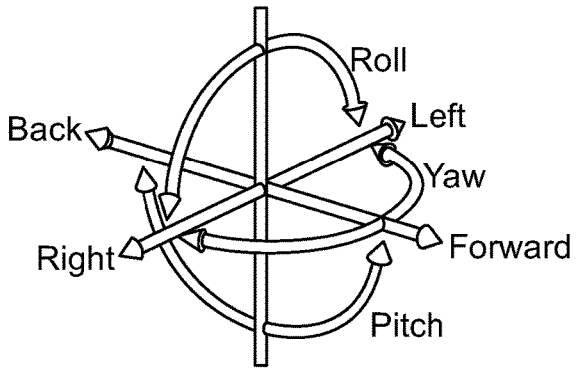
FIG. 8 is a schematic depiction of degrees of freedom of the apparatus, according to an example implementation.

FIG. 8 is a schematic depiction of degrees of freedom of the apparatus 100, according to an example implementation. FIG. 8 illustrates that the apparatus 100 enables the pivot bracket 116 to move along five degrees of freedom that may include forward/back, left/right, pitch, yaw, and roll.

Thus, the apparatus 100 enables the first connector 102 to automatically align with a pulling force of the cables 108 of the second connector 106 so that a disconnection or decoupling of the first connector 102 and the second connector 106 can occur with little or no binding. The multiple degrees of freedom of movement provided by the bracket 110 including pitch, roll, yaw as well as shifting in an x-y plane enables a smooth disconnect of the first connector 102 from the second connector 106 regardless of any orientation of the first connector 102 and the second connector 106. In addition, within some examples, the multiple degrees of freedom of movement provided by the bracket 110 enable self-aligning of the first connector 102 to the pulling force of the cables 108. Thus, in an example where the second connector 106 and the first connector 102 are pulled apart, and the second connector 106 and the first connector 102 are not aligned with the pulling force, the pivot bracket 116 can enable self-aligning (through translational and/or rotational movement) toward the pulling force to prevent binding during decoupling. Preventing binding can be particularly useful in applications where two different connectors are separating from one another, and each of the connectors may be influenced by a different set of physical factors due to high speed, motion/rotation, mass etc.

Figure 9:
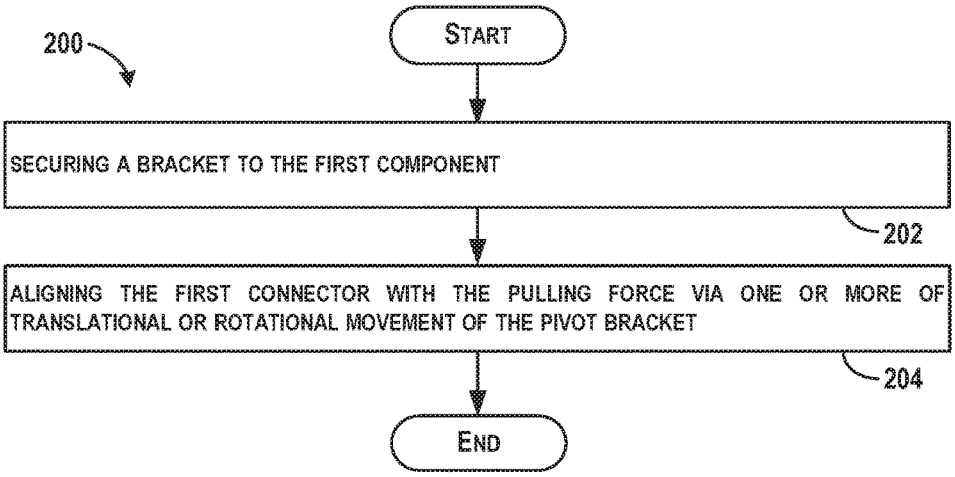
FIG. 9 shows a flowchart of an example method for reducing risk of binding between two connectors during decoupling of the two connectors, according to an example implementation.

FIG. 9 shows a flowchart of an example method 200 for reducing risk of binding between two connectors during decoupling of the two connectors, according to an example implementation. Method 200 shown in FIG. 9 presents an example of a method that could be used with the apparatus 100 shown in FIGS. 1-3, and/or the bracket 110 shown in FIGS. 4-7, for example. In some instances, components of the devices and/or apparatuses may be configured to perform the functions such that the components are actually configured and structured to enable such performance. In other examples, components of the devices and/or apparatuses may be arranged to be adapted to, capable of, or suited for performing the functions, such as when operated in a specific manner. Method 200 may include one or more operations, functions, or actions as illustrated by one or more of blocks 202-204. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

It should be understood that for this and other processes and methods disclosed herein, flowcharts show functionality and operation of one possible implementation of present examples. Alternative implementations are included within the scope of the examples of the present disclosure in which functions may be executed out of order from that shown or discussed, including substantially concurrent or in reverse order, depending on the functionality involved, as would be understood by those reasonably skilled in the art.

The method 200 is useful in example scenarios with the first connector 102 associated with the first component 104 and the second connector 106 attached to the cable(s) 108 that is subjected to a pulling force to effect decoupling.

At block 202, the method 200 includes securing the bracket 110 to the first component 104. The bracket 110 may be secured to the first component 104 through the cable(s) 103 or through other means such as screws, bolts, snap-fit, etc.

At block 204, the method 200 includes aligning the first connector 102 with the pulling force via one or more of translational or rotational movement of the pivot bracket 116.

Figure 10:
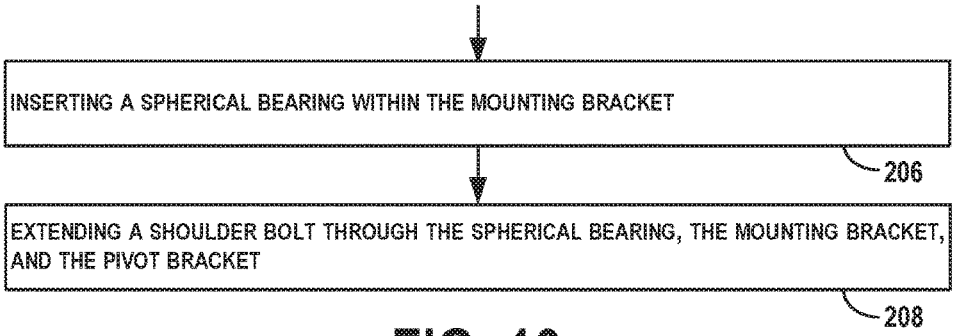
FIG. 10 shows a flowchart of an example method for use with the method in FIG. 9, according to an example implementation.

FIG. 10 shows a flowchart of an example method for use with the method 200, according to an example implementation. At block 206, the method 200 includes inserting the spherical bearing 114 within the mounting bracket 112. At block 208, the method 200 includes extending the shoulder bolt 118 through the spherical bearing 114, the mounting bracket 112, and the pivot bracket 116. In some examples, the positioning of the shoulder bolt 118 enables translational movement of the pivot bracket 116.

Figure 11:
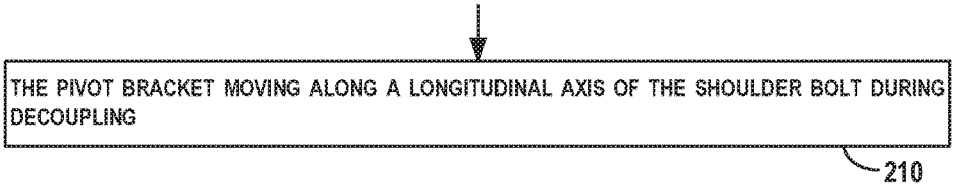
FIG. 11 shows a flowchart of another example method for use with the method in FIG. 9, according to an example implementation.

FIG. 11 shows a flowchart of another example method for use with the method 200, according to an example implementation. At block 210, the method 200 includes the pivot bracket 116 moving along a longitudinal axis of the shoulder bolt 118 during decoupling.

Figure 12:
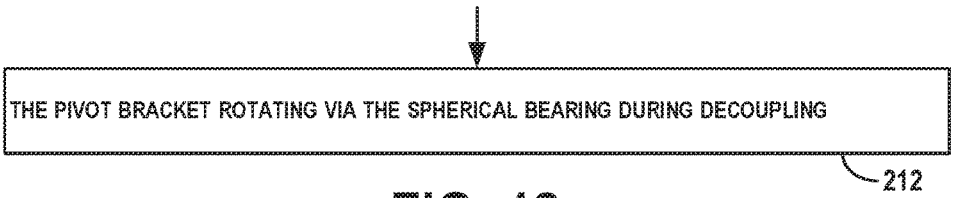
FIG. 12 shows a flowchart of another example method for use with the method in FIG. 9, according to an example implementation.

FIG. 12 shows a flowchart of another example method for use with the method 200, according to an example implementation. At block 212, the method 200 includes the pivot bracket 116 rotating via the spherical bearing 114 during decoupling.

Figure 13:
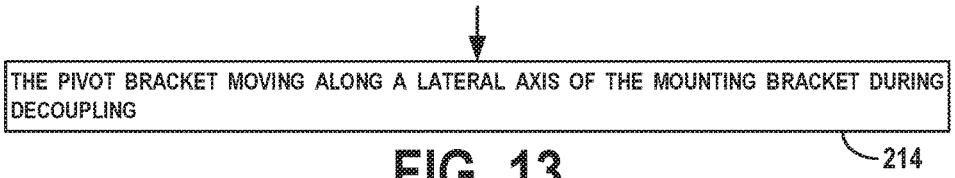
FIG. 13 shows a flowchart of another example method for use with the method in FIG. 9, according to an example implementation.

FIG. 13 shows a flowchart of another example method for use with the method 200, according to an example implementation. At block 214, the method 200 includes the pivot bracket 116 moving along a lateral axis of the mounting bracket 112 during decoupling.

Figure 14:
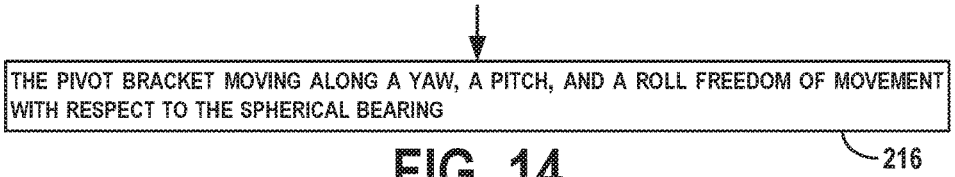
FIG. 14 shows a flowchart of another example method for use with the method in FIG. 9, according to an example implementation.

FIG. 14 shows a flowchart of another example method for use with the method 200, according to an example implementation. At block 216, the method 200 includes the pivot bracket 116 moving along a yaw, a pitch, and a roll freedom of movement with respect to the spherical bearing 114.

Figure 15:
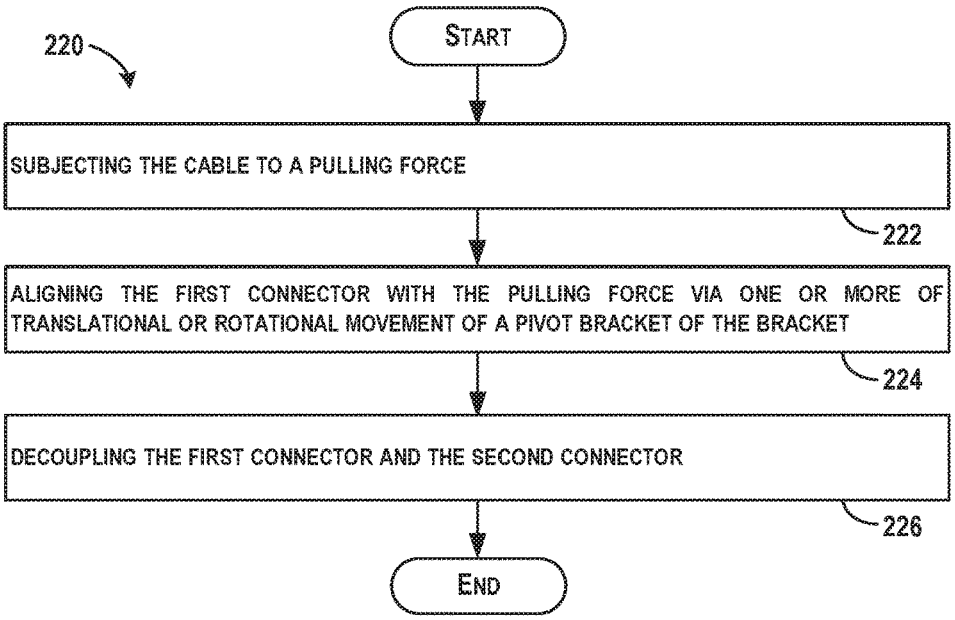
FIG. 15 shows another flowchart of an example method for decoupling two connectors, according to an example implementation.

FIG. 15 shows another flowchart of an example method 220 for decoupling two connectors, according to an example implementation. Method 220 shown in FIG. 15 presents an example of a method that could be used with the apparatus 100 shown in FIGS. 1-3, and/or the bracket 110 shown in FIGS. 4-7, for example. In some instances, components of the devices and/or apparatuses may be configured to perform the functions such that the components are actually configured and structured to enable such performance. In other examples, components of the devices and/or apparatuses may be arranged to be adapted to, capable of, or suited for performing the functions, such as when operated in a specific manner. Method 220 may include one or more operations, functions, or actions as illustrated by one or more of blocks 220-226. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

The method 220 is useful in example scenarios with the first connector 102 associated with the first component 104 rigidly affixed to the bracket 110 that supports the first connector 102 and the second connector 106 is attached to the cable(s) 108.

At block 222, the method 220 includes subjecting the cable(s) 108 to a pulling force. The pulling force may be performed in a number of manners, such as causing the second component 109 to move away from the first component 104. This can be performed manually, or autonomously.

At block 224, the method 220 includes aligning the first connector 102 with the pulling force via one or more of translational or rotational movement of the pivot bracket 116 of the bracket 110.

At block 226, the method 220 includes decoupling the first connector 102 and the second connector 106. The first connector 102 and the second connector 106 may snap into one another and decoupling can be performed by pulling the two connectors apart, or by application of the pulling force to the cable(s) 108, for example. Thus, the first connector 102 and the second connector 106 may not be rigidly affixed to one another so that they can be decoupled using the pulling force.

Figure 16:
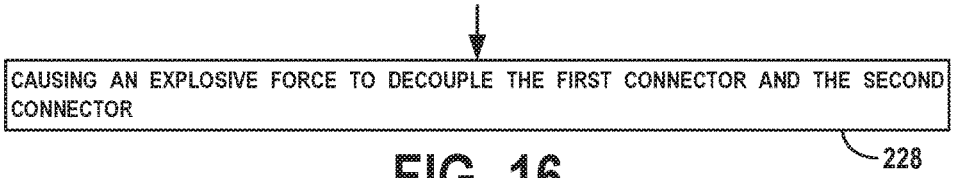
FIG. 16 shows a flowchart of an example method for use with the method in FIG. 15, according to an example implementation.

FIG. 16 shows a flowchart of an example method for use with the method 220, according to an example implementation. At block 228, the method 220 includes causing an explosive force to decouple the first connector 102 and the second connector 106. The explosive force may be an example autonomous method of subjecting the cable to the pulling force.

Figure 17:
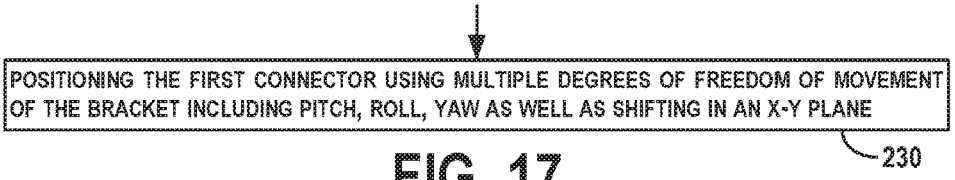
FIG. 17 shows a flowchart of another example method for use with the method in FIG. 15, according to an example implementation.

FIG. 17 shows a flowchart of another example method for use with the method 220, according to an example implementation. At block 230, the method 220 includes positioning the first connector 102 using multiple degrees of freedom of movement of the pivot bracket 116 including pitch, roll, yaw as well as shifting in an x-y plane. Such positioning helps to align the first connector 102 with the pulling force.

Figure 18:
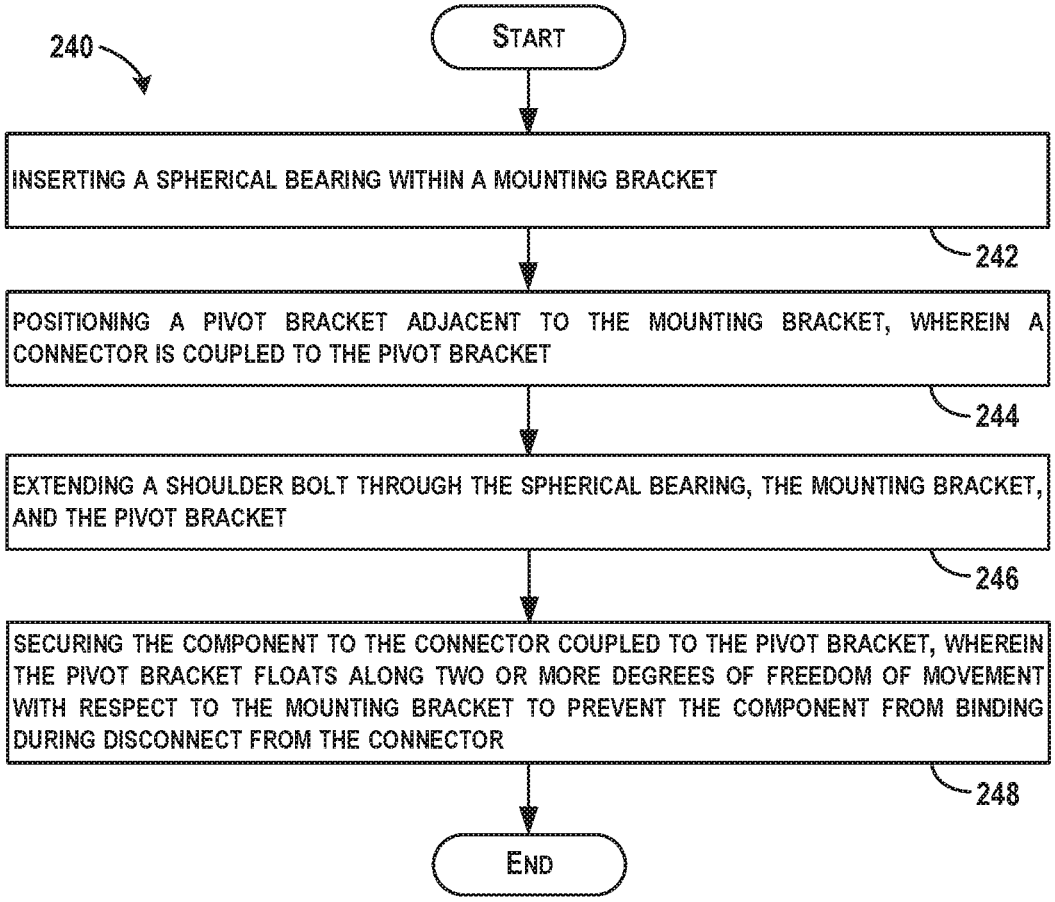
FIG. 18 shows another flowchart of an example method of coupling the second component to the bracket to reduce risk of binding during decoupling, according to an example implementation.

FIG. 18 shows another flowchart of an example method 240 of coupling the second component 109 to the bracket 110 to reduce risk of binding during decoupling, according to an example implementation. Method 240 shown in FIG. 18 presents an example of a method that could be used with the apparatus 100 shown in FIGS. 1-3, and/or the bracket 110 shown in FIGS. 4-7, for example. In some instances, components of the devices and/or apparatuses may be configured to perform the functions such that the components are actually configured and structured to enable such performance. In other examples, components of the devices and/or apparatuses may be arranged to be adapted to, capable of, or suited for performing the functions, such as when operated in a specific manner. Method 240 may include one or more operations, functions, or actions as illustrated by one or more of blocks 242-248. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

At block 242, the method 240 includes inserting the spherical bearing 114 within the mounting bracket 112.

At block 244, the method 240 includes positioning the pivot bracket 116 adjacent to the mounting bracket 112, and the first connector 102 is coupled to the pivot bracket 116.

At block 246, the method 240 includes extending the shoulder bolt 118 through the spherical bearing 114, the mounting bracket 112, and the pivot bracket 116.

At block 248, the method 240 includes securing the first component 104 to the first connector 102 coupled to the pivot bracket 116, and the pivot bracket 116 floats along two or more degrees of freedom of movement with respect to the mounting bracket 112 to prevent the first component 104 from binding during disconnect from the first connector 102.

Figure 19:
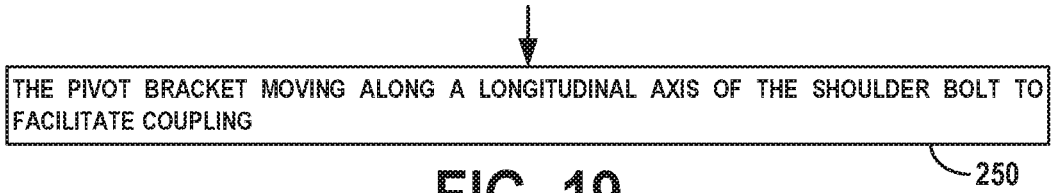
FIG. 19 shows a flowchart of an example method for use with the method in FIG. 18, according to an example implementation.

FIG. 19 shows a flowchart of an example method for use with the method 240, according to an example implementation. At block 250, the method 240 includes the pivot bracket 116 moving along a longitudinal axis of the shoulder bolt 118 to facilitate coupling.

Figure 20:
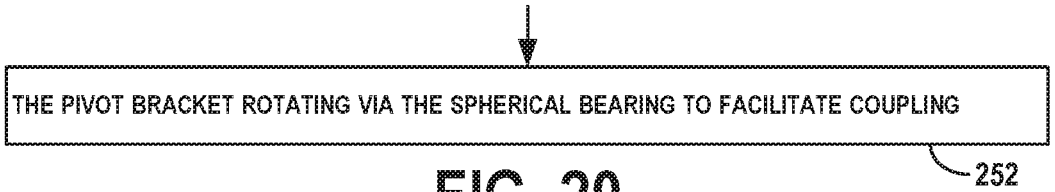
FIG. 20 shows a flowchart of another example method for use with the method in FIG. 18, according to an example implementation.

FIG. 20 shows a flowchart of another example method for use with the method 240, according to an example implementation. At block 252, the method 240 includes the pivot bracket 116 rotating via the spherical bearing 114 to facilitate coupling.

Example processes illustrated in the flowcharts in FIGS. 9-20 may be performed or carried out manually by a system integrator, a third party, and/or an operator (e.g., a customer). In addition, or alternatively, example processes illustrated in the flowcharts in FIGS. 9-20 may be performed or carried out autonomously via various methods described herein.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the disclosure.

The description of the different advantageous arrangements has been presented for purposes of illustration and description, and is not intended to be exhaustive or limited to the examples in the form disclosed. Many modifications and variations will be apparent to those of ordinary skill in the art. Further, different advantageous examples may describe different advantages as compared to other advantageous examples. The example or examples selected are chosen and described in order to best explain the principles of the examples, the practical application, and to enable others of ordinary skill in the art to understand the disclosure for various examples with various modifications as are suited to the particular use contemplated.

It is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

What is claimed is:

1. An apparatus for reducing risk of binding between two connectors during decoupling of the two connectors, wherein a first connector is associated with a first component and a second connector is attached to a cable that is subjected to a pulling force to effect decoupling, the apparatus comprising:

a bracket that is rigidly affixed to the first component and that supports the first connector so as to enable the first connector to automatically align with the pulling force, wherein the bracket comprises:

a mounting bracket;

a pivot bracket disposed adjacent the mounting bracket; and a shoulder bolt extending through the mounting bracket and the pivot bracket enabling movement of the pivot bracket with respect to the mounting bracket.

2. The apparatus of claim 1, wherein the bracket imparts multiple degrees of freedom of movement to the first connector.

3. The apparatus of claim 2, wherein the multiple degrees of freedom of movement comprise pitch, roll, yaw as well as shifting in an x-y plane.

4. The apparatus of claim 1, wherein the bracket further comprises:

a spherical bearing disposed within the mounting bracket;

wherein the shoulder bolt extends through the spherical bearing, the mounting bracket, and the pivot bracket.

5. The apparatus of claim 4, wherein the shoulder bolt is oversized enabling the pivot bracket to move along a longitudinal axis of the shoulder bolt.

6. The apparatus of claim 4, wherein the mounting bracket includes a mount in which the spherical bearing is disposed, and the pivot bracket is positioned over the mount with the shoulder bolt extending through the spherical bearing, the mount, and the pivot bracket.

7. The apparatus of claim 6, wherein the pivot bracket is positioned over the mount and a space resides between the shoulder bolt and the pivot bracket.

8. The apparatus of claim 4, wherein:

the mounting bracket includes a base, and a first arm and a second arm coupled to sides of the base, wherein a first end of the pivot bracket is coupled to a mount of the base and a second end of the pivot bracket is coupled to the first connector, and wherein the first arm and the second arm of the mounting bracket extend beyond the second end of the pivot bracket.

9. The apparatus of claim 8, wherein the pivot bracket is attached to the mounting bracket and a space is provided between the second end of the pivot bracket and each of the first arm and the second arm enabling the pivot bracket to rotate via the spherical bearing with respect to the mounting bracket.

10. The apparatus of claim 4, wherein the pivot bracket is connected to the mounting bracket via the shoulder bolt and the spherical bearing enabling five degrees of freedom of movement of the pivot bracket with respect to the mounting bracket.

11. The apparatus of claim 4, wherein:

the pivot bracket includes an opening through which the shoulder bolt extends enabling longitudinal translation freedom of movement, the pivot bracket is coupled to the mounting bracket with clearance enabling lateral translation freedom of movement, and the pivot bracket is coupled to the spherical bearing with clearance enabling yaw, pitch, and roll freedom of movement.

12. A method for reducing risk of binding between two connectors during decoupling of the two connectors, wherein a first connector is associated with a first component and a second connector is attached to a cable that is subjected to a pulling force to effect decoupling, the method comprising:

securing a bracket to the first component, wherein the bracket includes a pivot bracket and a mounting bracket, and wherein the pivot bracket is disposed adjacent the mounting bracket;

extending a shoulder bolt through the mounting bracket and the pivot bracket; and aligning the first connector with the pulling force via one or more of translational or rotational movement of the pivot bracket.

13. The method of claim 12, further comprising:

inserting a spherical bearing within the mounting bracket; and extending the shoulder bolt through the spherical bearing, the mounting bracket, and the pivot bracket.

14. The method of claim 13, further comprising:

the pivot bracket moving along a longitudinal axis of the shoulder bolt during decoupling.

15. The method of claim 13, further comprising:

the pivot bracket rotating via the spherical bearing during decoupling.

16. The method of claim 13, wherein the pivot bracket is coupled to the mounting bracket with clearance, and the method further comprises:

the pivot bracket moving along a lateral axis of the mounting bracket during decoupling.

17. The method of claim 13, wherein the pivot bracket is coupled to the spherical bearing with clearance, and the method further comprises:

the pivot bracket moving along a yaw, a pitch, and a roll freedom of movement with respect to the spherical bearing.

18. A method of decoupling two connectors, wherein a first connector is associated with a first component rigidly affixed to a bracket that supports the first connector and a second connector is attached to a cable, wherein the bracket includes a pivot bracket disposed adjacent a mounting bracket and a shoulder bolt extending through the mounting bracket and the pivot bracket, the method comprising:

subjecting the cable to a pulling force;

aligning the first connector with the pulling force via one or more of translational or rotational movement of the pivot bracket with respect to the mounting bracket; and decoupling the first connector and the second connector.

19. The method of claim 18, wherein subjecting the cable to the pulling force comprises causing an explosive force to decouple the first connector and the second connector.

20. The method of claim 18, wherein aligning the first connector with the pulling force comprises:

positioning the first connector using multiple degrees of freedom of movement of the pivot bracket including pitch, roll, yaw as well as shifting in an x-y plane.

* * * * *